US007472557B2

(12) United States Patent
Kang et al.

(10) Patent No.: US 7,472,557 B2
(45) Date of Patent: Jan. 6, 2009

(54) AUTOMATIC REFRIGERANT CHARGING APPARATUS

(75) Inventors: Pengju Kang, Hartford, CT (US); Sivakumar Gopalnarayanan, Simsbury, CT (US); Dong Luo, South Windsor, CT (US); Timothy P. Galante, West Hartford, CT (US)

(73) Assignee: Carrier Corporation, Farmington, CT (US)

( * ) Notice: Subject to any disclaimer, the term of this patent is extended or adjusted under 35 U.S.C. 154(b) by 625 days.

(21) Appl. No.: 11/025,351

(22) Filed: Dec. 27, 2004

(65) Prior Publication Data

US 2006/0137366 A1 Jun. 29, 2006

(51) Int. Cl.
*F25B 17/00* (2006.01)
*F25B 45/00* (2006.01)
*F25B 49/00* (2006.01)

(52) U.S. Cl. ..... 62/147; 62/77; 62/127

(58) Field of Classification Search ..... 62/149, 62/77, 127, 129, 208, 125
See application file for complete search history.

(56) References Cited

U.S. PATENT DOCUMENTS 4,114,448 A * 9/1978 Merritt ..... 62/129
4,381,549 A 4/1983 Stamp, Jr. et al.
4,429,578 A 2/1984 Darrel et al.
4,510,576 A 4/1985 MacArthur et al.
4,841,734 A 6/1989 Torrence
4,889,149 A * 12/1989 Weaver et al. ..... 137/1
5,079,930 A 1/1992 Beaverson et al.
5,156,012 A 10/1992 Kuribara et al.
5,214,918 A 6/1993 Oguni et al.
5,228,304 A 7/1993 Ryan
H1226 H 9/1993 VanReene et al.
5,241,833 A 9/1993 Ohkoshi
5,248,168 A 9/1993 Chichester et al.
5,251,453 A 10/1993 Stanke et al.
5,295,360 A 3/1994 Olds et al.
5,354,103 A 10/1994 Torrence et al.
5,362,530 A 11/1994 Kitami et al.
5,374,084 A 12/1994 Potokar
5,381,669 A 1/1995 Bahel et al.
5,406,980 A 4/1995 Allread et al.
5,413,147 A 5/1995 Moreiras et al.
5,425,558 A 6/1995 Dennany, Jr.
5,463,377 A 10/1995 Kronberg
5,464,042 A 11/1995 Haunhorst
5,468,028 A 11/1995 Olson
5,474,336 A 12/1995 Hoff et al.

(Continued)

FOREIGN PATENT DOCUMENTS

EP 0 159 281 5/1990

(Continued)

*Primary Examiner*—Chen-Wen Jiang
(74) *Attorney, Agent, or Firm*—Marjama, Muldoon Blasiak & Sullivan LLP

(57) ABSTRACT

An air conditioning system includes a plurality of sensors for sensing temperature and/or pressure conditions of the system which collectively indicate the actual refrigerant charge level in the system. This level is then compared with optimum level values that are stored in memory, and the difference between the two is used to indicate whether the system is properly charged. If not, the difference is applied to open a charge valve or a purge valve to automatically install additional refrigerant or to remove refrigerant so as to establish an optimum volume of refrigerant in the system.

16 Claims, 2 Drawing Sheets

U.S. PATENT DOCUMENTS

| | | | | |
|---|---|---|---|---|
| 5,540,463 | A | 7/1996 | Potokar | |
| 5,752,726 | A | 5/1998 | Fixemer | |
| 5,834,943 | A | 11/1998 | Miller | |
| 5,868,437 | A | 2/1999 | Teague | |
| 5,961,157 | A | 10/1999 | Baron et al. | |
| 6,012,743 | A | 1/2000 | Godeau et al. | |
| 6,155,612 | A | 12/2000 | Szabo | |
| 6,302,654 | B1 | 10/2001 | Millet et al. | |
| 6,308,523 | B1 | 10/2001 | Scaringe | |
| 6,324,854 | B1 * | 12/2001 | Jayanth | 62/127 |
| 6,354,332 | B1 | 3/2002 | Burkhardt et al. | |
| 6,382,678 | B1 | 5/2002 | Field et al. | |
| 6,481,756 | B1 | 11/2002 | Field et al. | |
| 6,497,435 | B1 | 12/2002 | Luft et al. | |
| 6,571,566 | B1 | 6/2003 | Temple et al. | |
| 6,843,070 | B1 * | 1/2005 | Suharno | 62/292 |
| 2002/0024218 | A1 | 2/2002 | Manuli | |
| 2002/0096209 | A1 | 7/2002 | Danielson et al. | |
| 2002/0141877 | A1 | 10/2002 | Jayanth et al. | |
| 2002/0182005 | A1 | 12/2002 | Milhas | |
| 2003/0089119 | A1 | 5/2003 | Pham et al. | |
| 2003/0182950 | A1 * | 10/2003 | Mei et al. | 62/129 |

FOREIGN PATENT DOCUMENTS

| | | |
|---|---|---|
| EP | 0 308 160 | 6/1991 |
| EP | 0 453 302 | 10/1991 |
| EP | 0 289 369 | 1/1992 |
| EP | 0 396 029 | 9/1992 |
| EP | 0 550 263 | 7/1993 |
| EP | 0 409 000 | 2/1994 |
| EP | 0 529 758 | 6/1996 |
| EP | 0 760 069 | 3/1997 |
| EP | 0 843 794 | 5/1998 |
| EP | 0 918 182 | 5/1999 |
| EP | 1 238 838 | 9/2002 |
| EP | 1 337 825 | 8/2003 |
| GB | 2 274 695 | 8/1994 |
| JP | 62-218748 | 9/1987 |
| JP | 62-261845 | 11/1987 |
| JP | 63-302238 | 12/1988 |
| JP | 2-110268 | 4/1990 |
| JP | 2-195165 | 8/1990 |
| JP | 4-55671 | 2/1992 |
| JP | 4-190062 | 7/1992 |
| JP | 4-273941 | 9/1992 |
| JP | 5-99475 | 4/1993 |
| JP | 5-231754 | 9/1993 |
| JP | 5-256543 | 10/1993 |
| JP | 7-55299 | 3/1995 |
| JP | 8-68576 | 3/1996 |
| JP | 8-261542 | 10/1996 |
| JP | 8-261543 | 10/1996 |
| JP | 2000-9048 | 1/2000 |
| JP | 2000-154954 | 6/2000 |
| JP | 2001-32884 | 2/2001 |
| JP | 2001-141279 | 5/2001 |
| WO | WO 93/20376 | 10/1993 |
| WO | WO 95/30106 | 11/1995 |
| WO | WO 95/30107 | 11/1995 |
| WO | WO 95/33157 | 12/1995 |
| WO | WO 96/17202 | 6/1996 |
| WO | WO 97/12167 | 4/1997 |
| WO | WO 97/13994 | 4/1997 |
| WO | WO 97/13995 | 4/1997 |
| WO | WO 97/47908 | 12/1997 |
| WO | WO 00/45053 | 8/2000 |
| WO | WO 01/23794 | 4/2001 |

* cited by examiner

AUTOMATIC REFRIGERANT CHARGING APPARATUS

BACKGROUND OF THE INVENTION

This invention relates generally to air conditioning systems and, more particularly, to a method and apparatus for determining proper refrigerant charge in such systems.

Maintaining proper refrigerant charge level is essential to the safe and efficient operation of an air conditioning system. Improper charge level, either in deficit or in excess, can cause premature compressor failure. An over-charge in the system results in compressor flooding, which, in turn, may be damaging to the motor and mechanical components. Inadequate refrigerant charge can lead to increased power consumption, thus reducing system capacity and efficiency. Low charge also causes an increase in refrigerant temperature entering the compressor, which may cause thermal over-load of the compressor. Thermal over-load of the compressor can cause degradation of the motor winding insulation, thereby bringing about premature motor failure.

Charge adequacy has traditionally been checked using either the "superheat method" or "subcool method". For air conditioning systems which use a thermal expansion valve (TXV), or an electronic expansion valve (EXV), the superheat of the refrigerant entering the compressor is normally regulated at a fixed value, while the amount of subcooling of the refrigerant exiting the condenser varies. Consequently, the amount of subcooling is used as an indicator for charge level. Manufacturers often specify a range of subcool values for a properly charged air conditioner. For example, a subcool temperature range between 10 and 15° F. is generally regarded as acceptable in residential cooling equipment. For air conditioning systems that use fixed orifice expansion devices instead of TXVs (or EXVs), the performance of the air conditioner is much more sensitive to refrigerant charge level. Therefore, superheat is often used as an indicator for charge in these types of systems. A manual procedure specified by the manufacturer is used to help the installer to determine the actual charge based on either the superheat or subcooling measurement. Table 1 summarizes the measurements required for assessing the proper amount of refrigerant charge.

TABLE 1

Measurements Required for Charge Level Determination

| | Superheat method | Subcooling method |
|---|---|---|
| 1 | Compressor suction temperature | Liquid line temperature at the inlet to expansion device |
| 2 | Compressor suction pressure | Condenser outlet pressure |
| 3 | Outdoor condenser coil entering air temperature | |
| 4 | Indoor returning wet bulb temperature | |

To facilitate the superheat method, the manufacturer provides a table containing the superheat values corresponding to different combinations of indoor return air wet bulb temperatures and outdoor dry bulb temperatures for a properly charged system. This charging procedure is an empirical technique by which the installer determines the charge level by trial-and-error. The field technician has to look up in a table to see if the measured superheat falls in the correct ranges specified in the table. Often the procedure has to be repeated several times to ensure the superheat stays in a correct range specified in the table. Consequently this is a tedious test procedure, and difficult to apply to air conditioners of different makers, or even for equipment of the same maker where different duct and piping configurations are used. In addition, the calculation of superheat or subcool requires the measurement of compressor suction pressure, which requires intrusive penetration of pipes.

In the subcooling method, as with the superheat method, the manufacturer provides a table listing the liquid line temperature required as a function of the amount of subcooling and the liquid line pressure. Once again, the field technician has to look up in the table provided to see if the measured liquid line temperature falls within the correct ranges specified in the table. Thus, this charging procedure is also an empirical, time-consuming, and a trial-and-error process.

Although air conditioning systems are generally charged with refrigerant when they leave the factory, the installation sites vary considerably as to piping distances and the like such that upon completion of the installation, refrigerant may be added or taken away from the system in order to reach optimal conditions. Further, leakage of refrigerant from a system is likely to occur over time so that periodically it is necessary to replenish the refrigerant charge in the system. Such a replenishment requires that a technician come to the site and go through one of the processes as described hereinabove, which can be time consuming and expensive.

SUMMARY OF THE INVENTION

Briefly, in accordance with one aspect of the invention, provision is made for the refrigerant charge condition of an air conditioning system to be sensed and for the charge volume to be automatically changed if found to not be at the desired level.

In accordance with another aspect of the invention, a plurality of sensors are installed within an air conditioning system to sense various temperature and pressure conditions that can be collectively used to determine the adequacy of refrigerant charge in the system. After determination has been made, the refrigerant charge volume is automatically, appropriately modified.

By yet another aspect of the invention, a microprocessor is included in the system along with a memory device for storing various algorithms and particular system operating parameters for firstly, calculating a prevalue indicative of refrigerant charge in the system and, secondly, comparing that value with a stored value indicative of optimal charge in the system.

By yet another aspect of the invention, a refrigerant replenishment tank is fluidly connected to the air conditioning system by way of valves which are selectively operated in response to comparisons made by the microprocessor to automatically add or withdraw refrigerant charge from the system in order to maintain optimal operating conditions.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
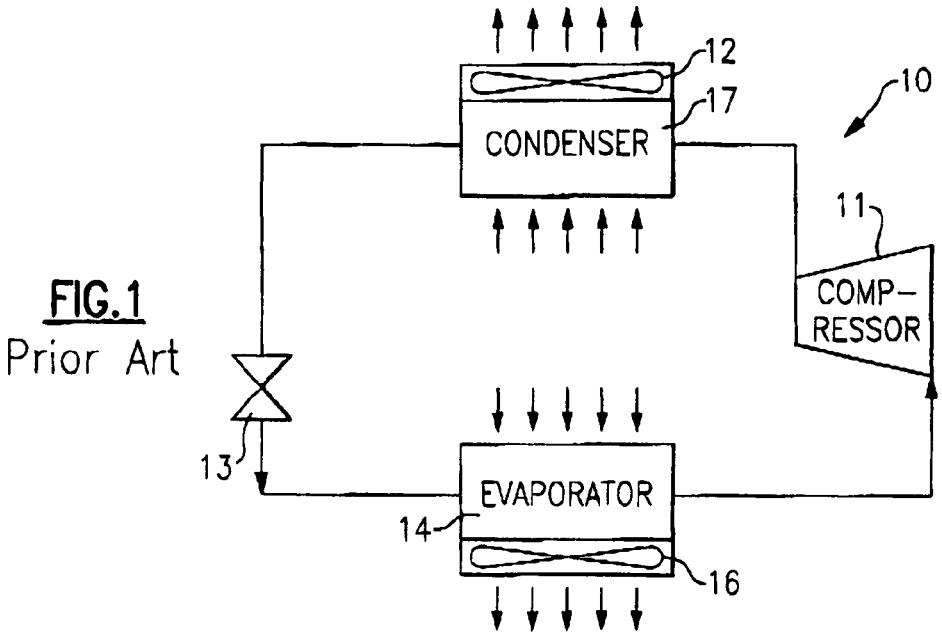
FIG.1 Prior Art
FIG. 1 is a schematic illustration of a prior art air conditioning system to which the present invention can be applied.

Referring now to FIG. 1, an air conditioning system is shown generally at 10 as having a compressor 11, a condenser 12, an expansion device 13 and an evaporator 14. In this regard, it should be recognized that the present invention is equally applicable for use with heat pump systems.

In operation, the refrigerant flowing through the evaporator 14 absorbs the heat in the indoor air being passed over the evaporator coil by the evaporator fan 16, with the cooled air than being circulated back into the indoor air to be cooled. After evaporation, the refrigerant vapor is pressurized in the compressor 11 and the resulting high pressure vapor is condensed into liquid refrigerant at the condenser 12, which rejects the heat in the refrigerant to the outdoor air being circulated over the condenser coil 12 by way of the condenser fan 17. The condensed refrigerant is then expanded by way of an expansion device 13, after which the saturated refrigerant liquid enters the evaporator 14 to continue the cooling process.

In a heat pump, during cooling mode, the process is identical to that as described hereinabove. In the heating mode, the cycle is reversed with the condenser and evaporator of the cooling mode acting as an evaporator and condenser, respectively.

It should be mentioned that the expansion device 13 may be a valve such as a TXV or an EXV which regulates the amount of liquid refrigerant entering the evaporator 14 in response to the superheat condition of the refrigerant entering the compressor 11. It may also be a fixed orifice, such as a capillary tube or the like.

In accordance with the present invention, there are various temperature and/or pressure conditions which can be sensed for assessing the charge level in the above described air conditioning system. A microprocessor then compares the findings with stored optimal values to determine the adequacy thereof and a charging system is responsively activated to correct any undesirable refrigerant charge conditions.

Figure 2:
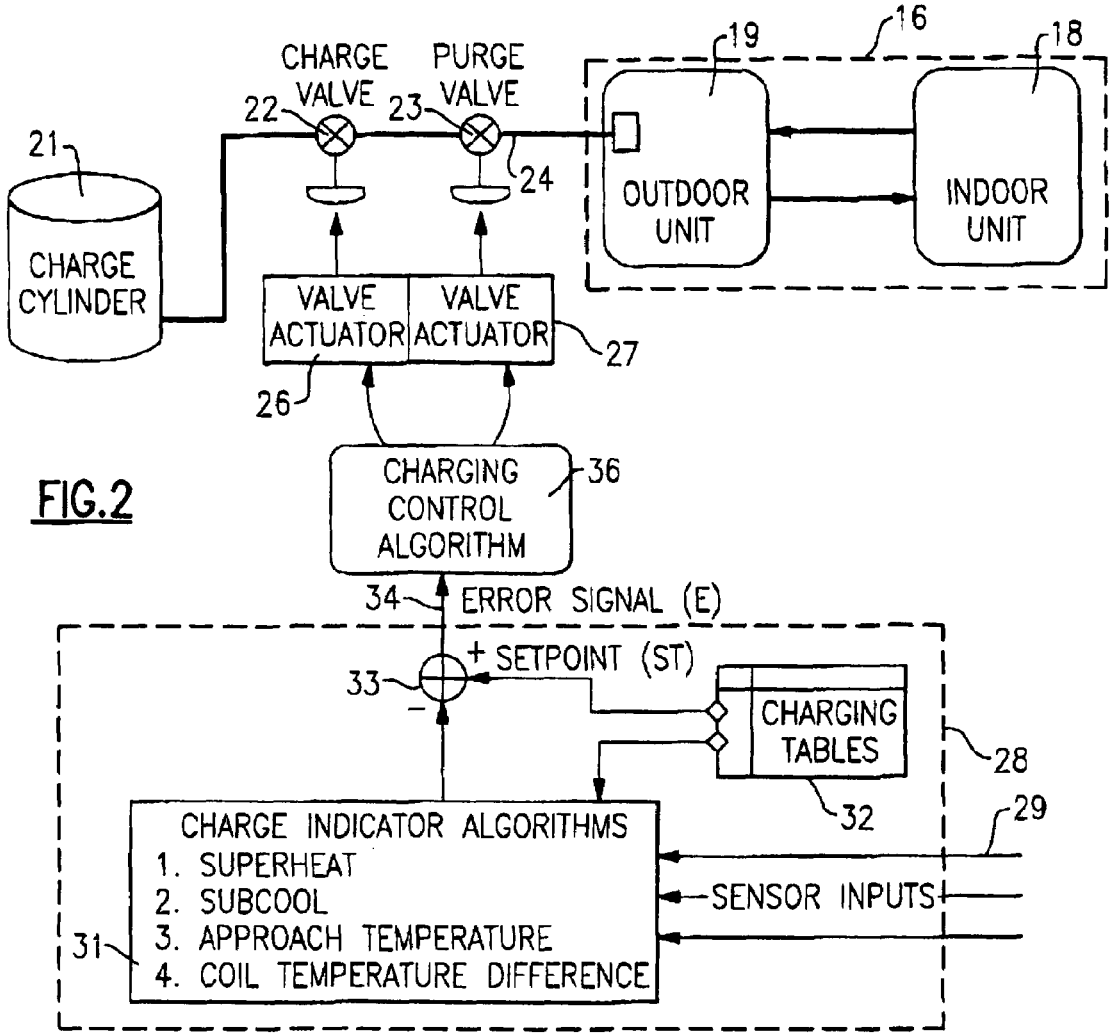
FIG. 2 is schematic illustration of an air conditioning system with the present invention incorporated therein.

Referring now to FIG. 2, the automatic charging system is shown as incorporated into the air conditioning system 10 with its indoor unit 18 including the expansion device 13 and evaporator 14, and the outdoor unit 19 which includes the compressor 11 and the condenser 12. The charging system includes a storage cylinder 21 for containing replenishment refrigerant, a charge valve 22 and a purge valve 23, all connected in series to the outdoor unit 19 by way of line 24. The charge valve 22, with its valve actuator 26, and the purge valve 23, with its valve actuator 27, are selectively controlled to either add or remove refrigerant from the system in a manner to be described more fully hereinafter.

A charging controller 28 is provided to determine, on the basis of various sensor measurements 29, such as temperatures and pressures used for the control of air conditioning system, whether the air conditioning system contains the desired amount of refrigerant charge. The charging controller 28 includes a microprocessor and appropriate memory devices such as RAMS or the like, to store charge indicator algorithms 31, together with charging tables 32. That is, the charge indicator algorithms 31 include a number of different algorithms that can be applied in connection with their respective methods for determining the amount of refrigerant in a system. This value will be referred to as the actual charge indicator. For example, the respective methods may include: 1) superheat, 2) subcool, 3) approach temperature and 4) coil temperature difference method, with each approach using specific sensed conditions for determining the relative amounts of refrigerant in the system as will be more fully described hereinafter. The technician may therefore choose one of the four methods as desired or most appropriate for determining the relative amount of refrigerant in the system.

Once the amount of refrigerant in the system, or the actual charge indicator has been determined, that value is then compared with an optimal charge value or values that have been established for a particular system and stored in the charging tables 32. The charging tables 32 therefore include test or model simulation data that has been obtained for particular systems that indicate optimal charge values which can then be compared with the actual charge indicator values obtained in applying one of the particular charge indicator algorithms 31 in order to determine the variants of the system from an optimal refrigerant charge condition. This comparison is made by a comparator 33 to obtain an error signal 34 which is then applied by the charging control algorithm 36 in order to selectively operate one of the valves 26 or 27 to change the volume of refrigerant charge in the system.

As an example, if the approach temperature method is applied as an indicator of the charge status, the required inputs can be the outdoor temperature $T_{OD}$ and temperature of the refrigerant leaving the condenser $T_{COND}$. After determining the optimal charge value for the system as indicated in the charging tables 32 these optimal charge values are stored in the charging tables as a function of indoor and outdoor conditions as presented in a table or map such as that as shown in FIG. 5 of U.S. patent application Ser. No. 11/025,836, assigned to the assignee of the present invention, and incorporated herein by reference. The actual charge indicator as calculated from the sensor inputs according to the approach temperature method are then compared with the set point value by the comparator 33 and, depending on the difference between these two values, the charge valve 22 or purge valve 23 can be appropriately operated until the unit is charged to the optimum condition.

Having described the manner in which the charging controller 28 is applied to actuate the valves 22 or 23 to automatically maintain an optimum charge in the system, the individual approaches or charge indicator algorithms 31 will now be described. The user can, of course, choose any of the algorithms depending on the application and availability of sensor installation in the unit.

Superheat Method

For air conditioning systems which use a fixed orifice expansion device, the superheat method is often used as a surrogate indicator for charge. The following measurements are required for the determination of actual charge level:

1) compressor suction temperature and pressure ($C_{ST}$ and $C_{SP}$)
2) indoor returning wet bulb temperature ($T_{wb}$)
3) outdoor condenser coil entering the air temperature ($T_{OD}$).

The superheat is calculated as: $SH=T_{REF}-T_{SAT}$ with $T_{SAT}$ being the saturation temperature as calculated from the compressor inlet or suction pressure $C_{SP}$, using the refrigerant property. $T_{REF}$ is the refrigerant temperature at the compressor inlet or suction ($C_{ST}$).

Subcool Method

For air conditioning systems which use a thermal expansion valve (TXV) or an electronic expansion valve (EXV), the superheat is normally regulated in a fixed value. Accordingly, the subcool method is used as the surrogate indicator for determining actual charge level. The subcool is calculated as:

$SC=T_{COND}-T_{SAT}$ wherein the $T_{COND}$ is the refrigerant temperature at the condenser outlet and the $T_{SAT}$ is the saturation temperature calculated from the compressor outlet pressure $C_{OP}$, using the refrigerant property.

A table, containing the optimum subcool values corresponding to different combinations of indoor return air wet bulb temperature and outdoor dry bulb temperatures for a properly charged system would be generated either through test or model simulation with the resulting data being programmed into the charging tables 32.

Approach Temperature Method

The approach temperature is a parameter used by engineers when designing heat exchangers for air compressors. A more common term used for this parameter is the cold temperature difference. In air compressor applications, it is the difference in temperature between the inlet water temperature and the discharge air temperature from the heat exchanger. That is, the approach temperature, $APT=T_{AIR\ OUT}-T_{WATER\ IN}$.

APT is an effective indicator used for assessing heat exchanger performance. The actual APT can be calculated using the temperature measurements using hand held meters or permanently installed temperature sensors. By comparing the difference between the calculated APT value and the expected APT value, which is specified by the heat exchanger designer, the performance of the heat exchanger can be evaluated. In a similar fashion, this established concept can be used for charge diagnostics of air conditioning systems. In the cooling applications, the condenser APT is defined as the difference in temperature between the inlet air temperature (i.e. outdoor air temperature $T_{OD}$) and the temperature of the refrigerant exiting the condenser ($T_{COND}$). That is, $APT=T_{COND}-T_{OD}$.

A table, containing the target APT values corresponding to different combinations of indoor return air wet bulb temperature and outdoor dry bulb temperatures for a properly charge system can be generated either through test or model simulation and subsequently programmed into the charging tables 32.

Condensing Temperature Difference Method

Traditionally the subcool calculation requires the measurement of compressor discharge pressure. In the present approach, we measure subcool using only temperature sensors. The subcool in this invention is defined as the condensing difference (CTD) between liquid leaving the condenser and condenser coil temperature ($T_{COIL}$). That is, $CTD=T_{COND}-T_{COIL}$.

$T_{COIL}$ is the condenser coil temperature. If the sensor is located in the central point of the condenser coil, this temperature should be close to the saturation temperature. In this way, intrusive measurement of compressor discharge pressure is avoided.

A table containing the optimal CTD values corresponding to different combination of indoor return air wet bulb temperature and outdoor dry bulb temperature for a properly charged systems can be generated either through test or model simulations and subsequently programmed into the charging tables 32.

Figure 3:
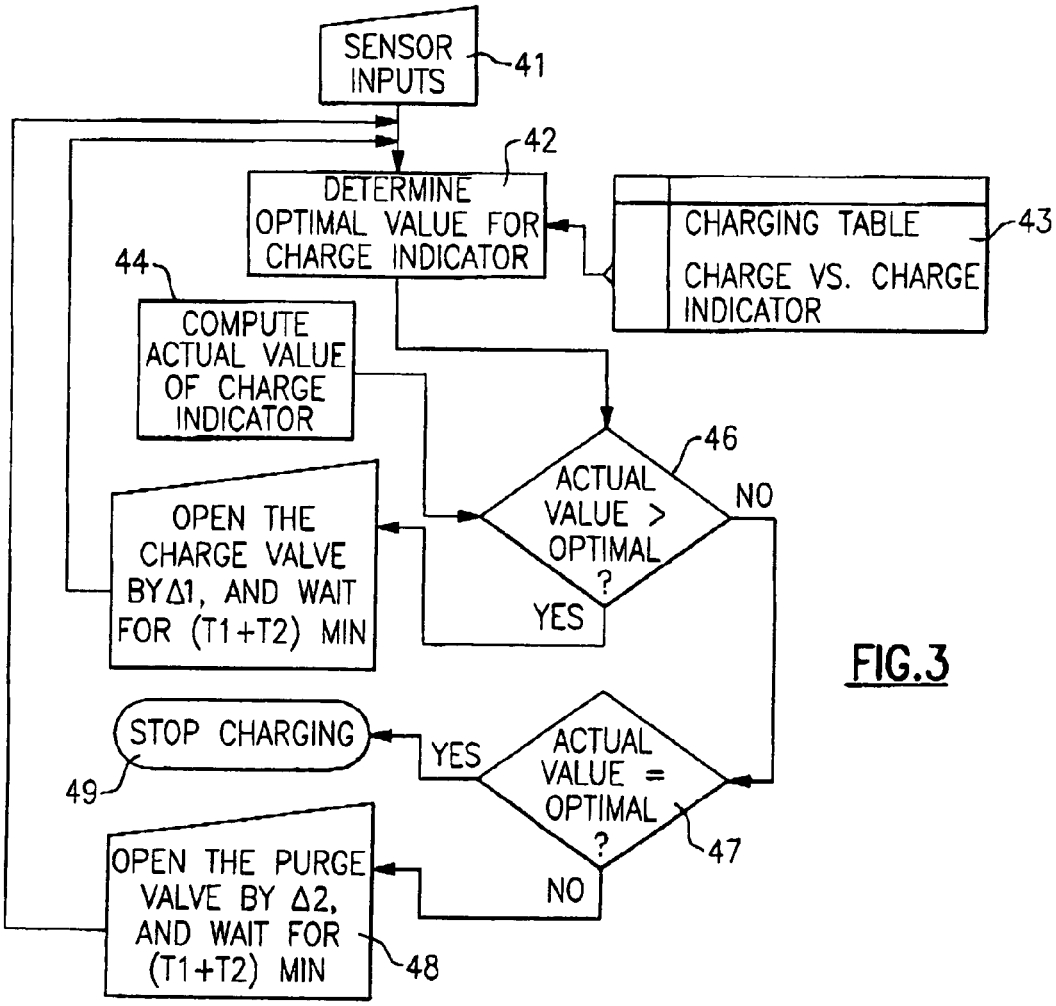
FIG. 3 is a flow chart indicating the method of sensing and automatically charging refrigerant in an air conditioning system in accordance with one embodiment of the invention.

Having described the apparatus, the method will now be described and is shown generally in FIG. 3. On the basis of the sensor inputs from block 41 and the type of air conditioning unit involved, the optimal value of the charge indicator for an air conditioning unit is determined as set forth in block 42. For example, if the approach temperature method is used for actual charge indication, the sensor inputs are the temperature of refrigerant leaving the condenser $T_{COND}$, the outdoor temperature, $T_{OD}$, and the indoor wet bulb temperature $T_{WB}$. The sensor inputs to the charging system are determined accordingly.

As shown in block 43, the charging tables 32 provides the optimal value of charge indicator versus indoor and outdoor air conditions.

Using the sensor inputs from block 41, the actual value of the selected charge indicator is calculated in block 44, and in block 46, the actual value of the charge indicator is compared with the optimum charge value determined in block 42. If the actual value is greater than the optimum charge value then we proceed to block 47 wherein the charge valve 22 is opened to a position Δ1 from its normally closed position. The opening position Δ1 is determined by the flow capacity of the charge valve 22. For avoidance of oscillation and control, a safe value for Δ1 is approximately 5% of the maximum range of the valve 22. After this opening operation, the valve 22 is held open at the open position for only T1 period time, after which it is closed to allow the proper amount of charge to flow into the unit, and then control is on a hold state for a period of T2 minutes to allow the unit to reach steady state condition. The value of T1 is determined by the flow capacity of the charge valve. A typical value for this waiting period is 5 seconds. The value of T2 is influenced by the capacity of the unit. Normally a 5-minute waiting period is sufficient. After the waiting period is over, the process is directed to block 42 where the process is repeated.

If the actual value is less than the optimal value as indicated at block 48, the unit is deemed overcharged and the purge valve 23 is opened by Δ2 from the normally closed position. The open position Δ2 is determined by the flow capacity of the purge valve 23. For avoidance of oscillations in control, a safe value for Δ2 is approximately 5% of the maximum range of the valve. After this opening operation, the purge valve 23 is held open for a period of T3 seconds, and it is then again closed to allow a certain amount of refrigerant to be purged out of the unit. Then the control is on a hold for T4 minutes to allow the unit to reach a steady state condition. The value of T4 can be determined by the capacity of the unit. Normally the 5 minute waiting period is sufficient for the system to reach steady state. After the waiting period is over the process is directed to block 42 to repeat the process.

In block 49, if the actual value of the charge indicator is found to be equal to or close to the optimal value, then the controller gives an indication that the system is optimally charged and all the valves are moved to the closed positions after which the service technician can then safely remove the charging system from the air conditioning unit as shown in block 51.

Figure 4:
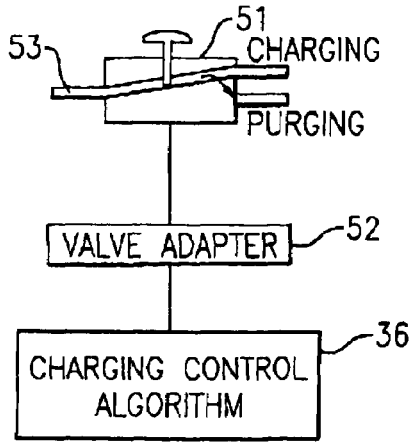
FIG. 4 is a schematic illustration of a valve in accordance with one embodiment of the invention.

Rather than the two valves 22 and 23 being used for charging and purging, respectively, it is possible to replace the two valves with a single valve 51 as shown in FIG. 4. Here, a single valve actuator 52, receiving its input from the charging control algorithm 36, operates to selectively place the valve 51 in a position as shown in FIG. 4 wherein the line 53 from the charge cylinder 22 is connected to the outdoor unit for the purpose of adding refrigerant charge to the system. Alternatively, the valve 51 may be placed in a purging position wherein excessive refrigerant from the outdoor unit 19 is purged to the atmosphere.

While the present invention has been particularly shown and described with reference to a preferred embodiment as illustrated in the drawings, it will be understood by one skilled in the art that various changes in detail may be effected therein without departing from the true spirit and scope of the invention as defined by the claims. One derivative of the present invention is the use of a single two-way valve for both refrigerant charge and purge. Turning this two-way valve to one direction would allow the refrigerant flow into the air conditioning unit, while turning valve to the opposite direction would allow the refrigerant to be purged from the air conditioning system.

We claim:

1. Apparatus for automatically adjusting the volume of refrigerant charge in an air conditioning system having a compressor, a condenser, an expansion device and a evaporator fluidly connected in serial refrigerant flow relationship comprising:

a plurality of sensors for respectively sensing a plurality of selected temperature and pressure conditions of the system;

memory means for storing representative values for said sensed conditions;

memory means for storing algorithms for computing charge level indicators as a function of said stored representative values;

memory means for storing optimal charge level indicators for at least one particular system;

comparison means for comparing said computed charge level indicators with said optimal charge level indicators to obtain a difference value;

a source of refrigerant fluidly connected to said system by way of at least one valve; and valve activating means for controlling said at least one valve in response to said difference value to change the level of refrigerant in said system wherein said plurality of selected temperature and pressure conditions includes either the combination of outdoor air temperature and condenser liquid refrigerant temperature or a combination of condenser liquid temperature and condenser coil temperature.

2. Apparatus as set forth in claim 1 wherein said plurality of sensors includes both temperature and pressure sensors.

3. Apparatus as set forth in claim 1 wherein said plurality of selected temperature and pressure conditions includes compressor suction temperature, compressor suction pressure, indoor wet bulb temperature and outdoor temperature.

4. Apparatus as set forth in claim 1 wherein said plurality of selected temperature and pressure conditions includes compressor outlet pressure and condenser outlet temperature.

5. Apparatus as set forth in claim 1 wherein said at least one valve includes a charging valve which, when opened, causes the flow of refrigerant from said refrigerant source to said system.

6. Apparatus as set forth in claim 1 wherein said at least one valve includes a purge valve which, when opened, causes refrigerant to flow from the system.

7. Apparatus as set forth in claim 1 wherein said at least one valve comprises a single valve that is adaptable for selectively causing refrigerant to flow into said system or be purged from said system.

8. Apparatus as set forth in claim 1 wherein said comparison means comprises a comparator.

9. A method of automatically adjusting the volume of refrigerant charge in an air conditioning system having a compressor, a condenser, an expansion device and a evaporator fluidly connected in serial refrigerant flow relationship comprising the steps of:

providing a plurality of sensors and respectively sensing a plurality of selected temperature and pressure conditions of the system;

storing respective values for said sensed conditions;

storing algorithms for and computing charge level indicators as a function of said stored representative values;

storing optimal charge level indicators for at least one particular system;

comparing said computed charge level indicators with said optimal charge level indicators to obtain a difference value;

providing a source of refrigerant fluidly connected to said system by way of at least one valve; and activating said at least one valve in response to said difference value to change the level of refrigerant in said system wherein said sensed temperature and pressure conditions include either the combination of outdoor air temperature and condenser liquid refrigerant temperature or a combination of condenser liquid temperature and condenser coil temperature.

10. A method as set forth in claim 9 wherein both temperature and pressure conditions are sensors.

11. A method as set forth in claim 9 wherein said sensed conditions include temperature and pressure conditions includes compressor suction temperature, compressor suction pressure, indoor wet bulb temperature and outdoor temperature.

12. A method as set forth in claim 9 wherein said sensed conditions include temperature and pressure conditions includes compressor outlet pressure and condenser outlet temperature.

13. A method as set forth in claim 9 wherein the activation of said at least one valve includes a charging valve which, when opened, causes the flow of refrigerant from said refrigerant source to said system.

14. A method as set forth in claim 9 wherein the activation of said at least one valve includes a purge valve which, when opened, causes refrigerant to flow from the system.

15. A method as set forth in claim 1 wherein the activation of said at least one valve includes the step of a single valve being selectively placed in a condition for adding refrigerant to said system or for purging refrigerant from said system.

16. A method as set forth in claim 9 wherein said comparing step is accomplished by a comparator.

* * * * *